US009142169B2

(12) United States Patent
Cheng et al.

(10) Patent No.: US 9,142,169 B2
(45) Date of Patent: Sep. 22, 2015

(54) DIGITAL TO ANALOG CONVERTER AND SOURCE DRIVER CHIP THEREOF

(71) Applicant: NOVATEK Microelectronics Corp., Hsin-Chu (TW)

(72) Inventors: Jhih-Siou Cheng, New Taipei (TW); Ju-Lin Huang, Hsinchu County (TW); Pang-Chan Hung, Kaohsiung (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 151 days.

(21) Appl. No.: 13/736,091

(22) Filed: Jan. 8, 2013

(65) Prior Publication Data

US 2014/0009373 A1 Jan. 9, 2014

(30) Foreign Application Priority Data

Jul. 5, 2012 (TW) ..... 101124214 A

(51) Int. Cl.
*G09G 3/36* (2006.01)

(52) U.S. Cl.
CPC ..... *G09G 3/36* (2013.01); *G09G 3/3685* (2013.01); *G09G 2310/027* (2013.01)

(58) Field of Classification Search
CPC .. G09G 3/36; G09G 3/3685; G09G 2310/027
USPC ..... 345/87, 89
See application file for complete search history.

(56) References Cited

U.S. PATENT DOCUMENTS

| | | | | |
|---|---|---|---|---|
| 5,952,948 | A * | 9/1999 | Proebsting | 341/144 |
| 6,326,913 | B1 * | 12/2001 | Chao et al. | 341/144 |
| 7,006,065 | B1 * | 2/2006 | Sugawara et al. | 345/89 |
| 7,193,595 | B2 * | 3/2007 | Lee et al. | 345/89 |
| 7,292,217 | B2 * | 11/2007 | Tseng et al. | 345/100 |
| 7,903,106 | B2 * | 3/2011 | Lan | 345/211 |
| 2005/0128113 | A1 * | 6/2005 | Kyung-Myun | 341/138 |
| 2007/0139328 | A1 * | 6/2007 | Lan | 345/89 |
| 2008/0291190 | A1 | 11/2008 | Kim et al. | |
| 2011/0122102 | A1 * | 5/2011 | Tso et al. | 345/204 |
| 2011/0205218 | A1 * | 8/2011 | Tsuchi et al. | 345/212 |

FOREIGN PATENT DOCUMENTS

| | | |
|---|---|---|
| CN | 102163400 A | 8/2011 |
| TW | I309110 | 4/2009 |
| TW | 201128600 | 8/2011 |

* cited by examiner

*Primary Examiner* — Temesgh Ghebretinsae
*Assistant Examiner* — Benyam Ketema
(74) *Attorney, Agent, or Firm* — Winston Hsu; Scott Margo

(57) ABSTRACT

A digital to analog converter for a source driver chip of a liquid crystal display device is disclosed. The digital to analog converter comprises an output terminal for outputting an output voltage, a plurality of receiving terminals for receiving a plurality of Gamma voltages, and a plurality of transmission paths comprising a plurality of first-type transistors coupled between the plurality of receiving terminals and the output terminal, respectively, for outputting one of the plurality of Gamma voltages as the output voltage according to a digital select signal; wherein a first transmission path corresponding to a first receiving terminal receiving a first Gamma voltage closest to a middle voltage among the plurality of Gamma voltages has lower on-resistance than other transmission paths among the plurality of transmission paths when a same source-to-gate voltage is applied.

20 Claims, 11 Drawing Sheets

DIGITAL TO ANALOG CONVERTER AND SOURCE DRIVER CHIP THEREOF

BACKGROUND OF THE INVENTION

1. Field of the Invention

The present invention relates to a digital to analog converter (DAC) and a source driver chip thereof, and more particularly, to a digital to analog converter and a source driver chip thereof capable of timely outputting Gamma voltages to a display to avoid abnormal display in many kinds of product applications.

2. Description of the Prior Art

In general, in a source driver chip of a liquid crystal display (LCD), a digital to analog converter may select a proper Gamma voltage from a plurality of Gamma voltages to output to an output stage according to a digital select signal, so as to drive a panel to display with accurate gray scales. In order to avoid continuously utilizing a voltage with a same polarity (e.g. positive polarity or negative polarity) to drive liquid crystal molecules, which reduces polarization or refraction of the liquid crystal molecules such that quality of image display deteriorates, the prior art has disclosed a method of dividing the Gamma voltages to positive Gamma voltages and negative Gamma voltages, to drive the liquid crystal molecules with reversed polarities.

In detail, please refer to FIG. 1, which is a schematic diagram of Gamma voltages. As shown in FIG. 1, a Gamma voltage greater than a middle voltage VDDA/2 is a positive Gamma voltage, which can drive the liquid crystal molecules with a positive polarity; a Gamma voltage less than the middle voltage VDDA/2 is a negative Gamma voltage, which can drive the liquid crystal molecules with a negative polarity, i.e. the middle voltage VDDA/2 is a middle value between a plurality of positive Gamma voltages and a plurality of negative Gamma voltages, wherein different digital select signals DSS are corresponding to different Gamma voltages to cause different gray scales.

In such a situation, please refer to FIG. 2A, which is a schematic diagram of a source driver chip 20. As shown in FIG. 2A, a positive Gamma voltage generator 202 can generate positive Gamma voltages VP[0]~VP[n] for a p-type digital to analog converter 206 to select one of the positive Gamma voltages VP[0]~VP[n] as an output voltage VOUTP to an output buffer 210 or 212 according to the digital select signal DSS, to drive the panel to display with specific gray scales. Similarly, a negative Gamma voltage generator 204 can generate negative Gamma voltages VN[0]~VN[n] for an n-type digital to analog converter 208 to select one of the negative Gamma voltages VN[0]~VN[n] as an output voltage VOUTN to an output buffer 210 or 212 according to the digital select signal DSS, to drive the panel to display with specific gray scales.

Under this structure, please refer to FIG. 2B and FIG. 2C, which are schematic diagrams of partial circuits of the p-type digital to analog converter 206 and the n-type digital to analog converter 208 in FIG. 2A, respectively. FIG. 2B and FIG. 2C only illustrate circuits related to positive Gamma voltages VP[n−3]~VP[n] and negative Gamma voltages VN[n−3]~VN[n] closest to the middle voltage VDDA/2 among the positive Gamma voltages VP[0]~VP[n] and the negative Gamma voltages VN[0]~VN[n] in the p-type digital to analog converter 206 and the n-type digital to analog converter 208, to illustrate the structures and operations of the p-type digital to analog converter 206 and the n-type digital to analog converter 208. Among those Gamma voltages, the negative Gamma voltage VN[n] and the positive Gamma voltage VP[n] are closest to the middle voltage VDDA/2.

As shown in FIG. 2B and FIG. 2C, in comparison with other digital to analog converters all utilizing logic gates (transmission gates) as switches for selecting to output the output voltage VOUTP, the source driver chip 20 can utilize a difference between polarities of two transmission paths, to implement p-type transistors as all of the switches for selecting to output the output voltage VOUTP in the p-type digital to analog converters 206, and implement n-type transistors as all of the switches for selecting to output the output voltage VOUTN in the n-type digital to analog converter 208, so as to reduce areas of the digital to analog converters 206 and 208 by half.

In detail, on-resistance of a transistor is negatively related to the overdrive voltage of the transistor. When the overdrive voltage rises, the on-resistance decreases; on the contrary, when the overdrive voltage falls, the on-resistance increases, wherein the overdrive voltage is a difference between the gate-to-source voltage and the threshold voltage of the transistor, i.e. Vgs−Vt. In such a situation, for the p-type digital to analog converter 206 all implemented by p-type transistors as switches, when the input Gamma voltage becomes higher, the gate-to-source voltage becomes higher and the overdrive voltage rises such that on-resistance becomes lower, and hence the p-type digital to analog converter 206 are suitable for selecting and outputting the positive Gamma voltages VP[0]~VP[n] since the positive Gamma voltages VP[0]~VP[n] gradually becomes greater than the middle voltage VDDA/2. Similarly, for the n-type digital to analog converter 208 all implemented by n-type transistors as switches, when the input Gamma voltage becomes lower, the gate-to-source voltage becomes higher and the overdrive voltage rises such that on-resistance becomes lower, and hence the n-type digital to analog converter 208 are suitable for selecting and outputting the negative Gamma voltages VN[0]~VN[n] since the negative Gamma voltages VN[0]~VN[n] gradually becomes smaller than the middle voltage VDDA/2.

On the other hand, take the p-type digital to analog converter 206 as an example to illustrate the operation of selecting and outputting Gamma voltages. The digital select signal DSS includes select signals SELB[n], SEL[n], SELB[n+1], SEL[n+1], and SELB[n+2]. The select signal SELB[n] may be a binary code. The select signal SEL[n] is an inverse signal of the select signal SELB[n], and the select signal SEL[n+1] is an inverse signal of the select signal SELB[n+1]. In such a condition, the select signals SELB[n] and SEL[n] can control to turn on both the p-type transistors MP1, MP3 or both the p-type transistors MP2, MP4 simultaneously, the select signals SELB[n+1] and SEL[n+1] can control to turn on the p-type transistor MP5 or MP6, and the select signal SELB[n+2] can control whether to turn on the p-type transistor MP7 (since the select signal SELB[n+2] still needs to be utilized for selecting and outputting the positive Gamma voltages VP[n−7]~VP[n−4]). In such a condition, by utilizing a series of binary codes of the digital select signal DSS for selection control, a transmission path between one of the positive Gamma voltages VP[0]~VP[n] and the output voltage VOUTP can be conducted as an output path to output the output voltage VOUTP, e.g. to turn on the p-type transistors MP4, MP6, MP7 and the follow-up p-type transistors to form a transmission path P1 between the positive Gamma voltage VP[n] and the output voltage VOUTP.

Similarly, in the n-type digital to analog converter 208, selection control can also be performed with a series of binary codes of the digital select signal DSS, and a transmission path between one of the negative Gamma voltages VN[0]~VN[n]

and the output voltage VOUTN can be conducted as an output path to output the output voltage VOUTN, e.g. to turn on the n-type transistors MN4, MN6, MN7 and the follow-up n-type transistors to form a transmission path N1 between the negative Gamma voltage VN[n] and the output voltage VOUTN. The above operation of performing output selection with a series of binary codes is well-known for those skilled in the art.

However, with the increase of definition, the quantity of transistors in the transmission paths may increase, such that on-resistance of the transmission paths may also increase, and the transmission time becomes longer accordingly. Therefore, in many kinds of product applications with high image updating rate, data can not be transmitted timely, which may cause abnormal display. Take the n-type digital to analog converter 208 as an example, when the quantity of n-type transistors in the transmission path increases, and the negative Gamma voltage increases and the overdrive voltage decreases, e.g. the Gamma voltage VN[n] closest to the middle voltage VDDA/2 and the corresponding transmission path N1, at this moment, on-resistance of each n-type transistor increases, and the quantity of turned-on transistors connected in-serial in the transmission path also increases, such that time constant of the transmission path increases, and thus a signal can not be outputted timely. Similarly, the same problem may appear in the positive Gamma voltage VP[n] closest to the middle voltage VDDA/2 and the corresponding transmission path P1 in the p-type digital to analog converter 206. Thus, there is a need for improvement of the prior art.

SUMMARY OF THE INVENTION

It is therefore an objective of the present invention to provide a digital to analog converter and the source driver chip thereof capable of timely outputting Gamma voltages to a display to avoid abnormal display in many kinds of product applications.

The present invention discloses a digital to analog converter, for a source driver chip of a liquid crystal display device. The digital to analog converter comprises an output terminal for outputting an output voltage, a plurality of receiving terminals for receiving a plurality of Gamma voltages, and a plurality of transmission paths comprising a plurality of first-type transistors coupled between the plurality of receiving terminals and the output terminal, respectively, for outputting one of the plurality of Gamma voltages as the output voltage according to a digital select signal; wherein a first transmission path corresponding to a first receiving terminal receiving a first Gamma voltage closest to a middle voltage among the plurality of Gamma voltages has lower on-resistance than other transmission paths among the plurality of transmission paths when a same source-to-gate voltage is applied.

The present invention further discloses a source driver chip for a liquid crystal display device. The source driver chip comprises at least one Gamma voltage generator for generating a plurality of Gamma voltages, respectively, at least one output buffer for performing driving with an output voltage, respectively, and at least one digital to analog converter, each comprising an output terminal for outputting the output voltage, a plurality of receiving terminals for receiving the plurality of Gamma voltages, and a plurality of transmission paths comprising a plurality of first-type transistors coupled between the plurality of receiving terminals and the output terminal, respectively, for outputting one of the plurality of Gamma voltages as the output voltage according to a digital select signal; wherein a first transmission path corresponding to a first receiving terminal receiving a first Gamma voltage closest to a middle voltage among the plurality of Gamma voltages has lower on-resistance than other transmission paths among the plurality of transmission paths when a same source-to-gate voltage is applied.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
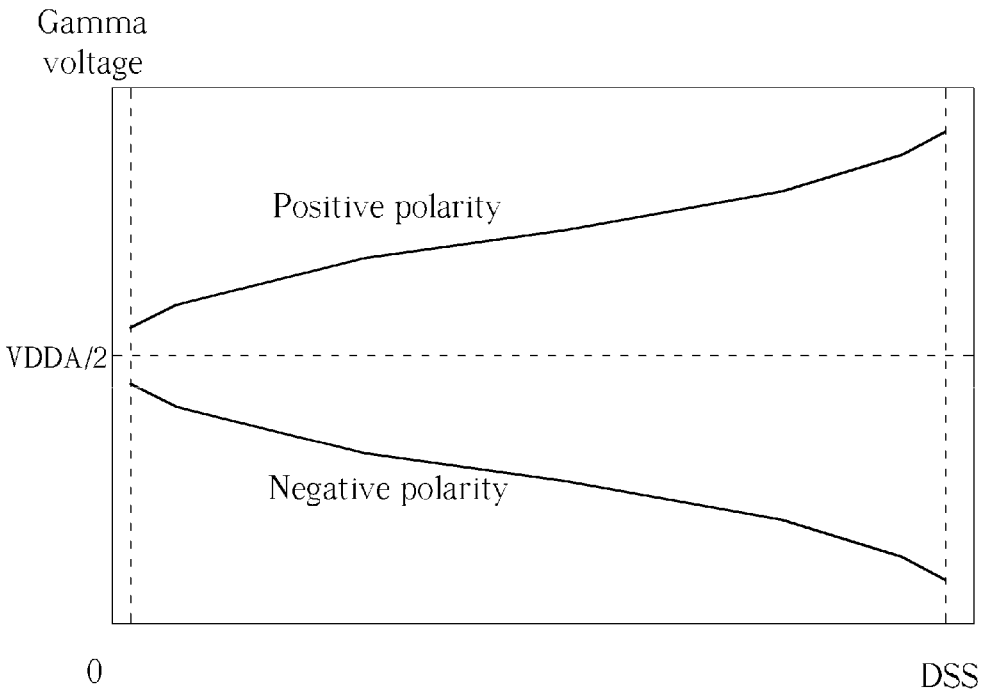
FIG. 1 PRIOR ART
FIG. 1 is a schematic diagram of Gamma voltages.
Figure 2A:
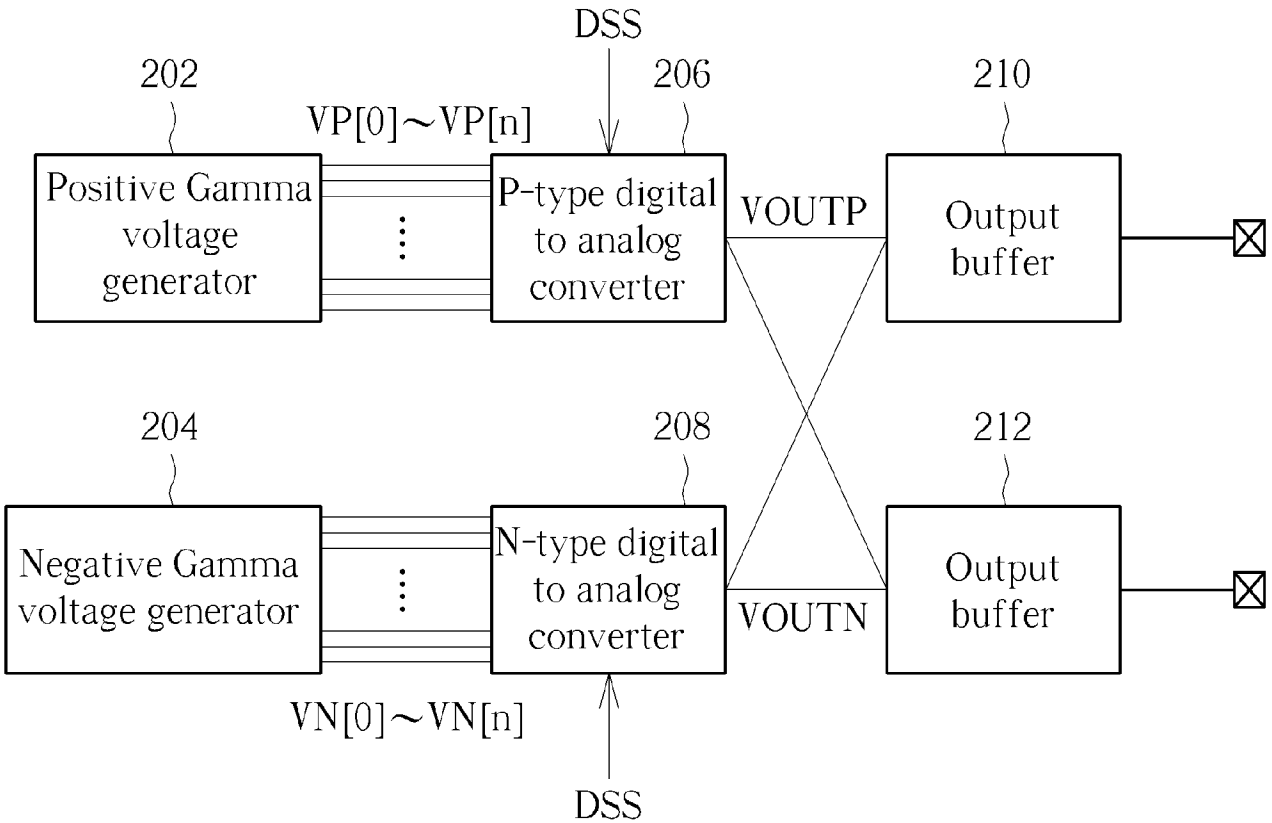
FIG. 2A PRIOR ART
FIG. 2A is a schematic diagram of a source driver chip.
Figure 2B:
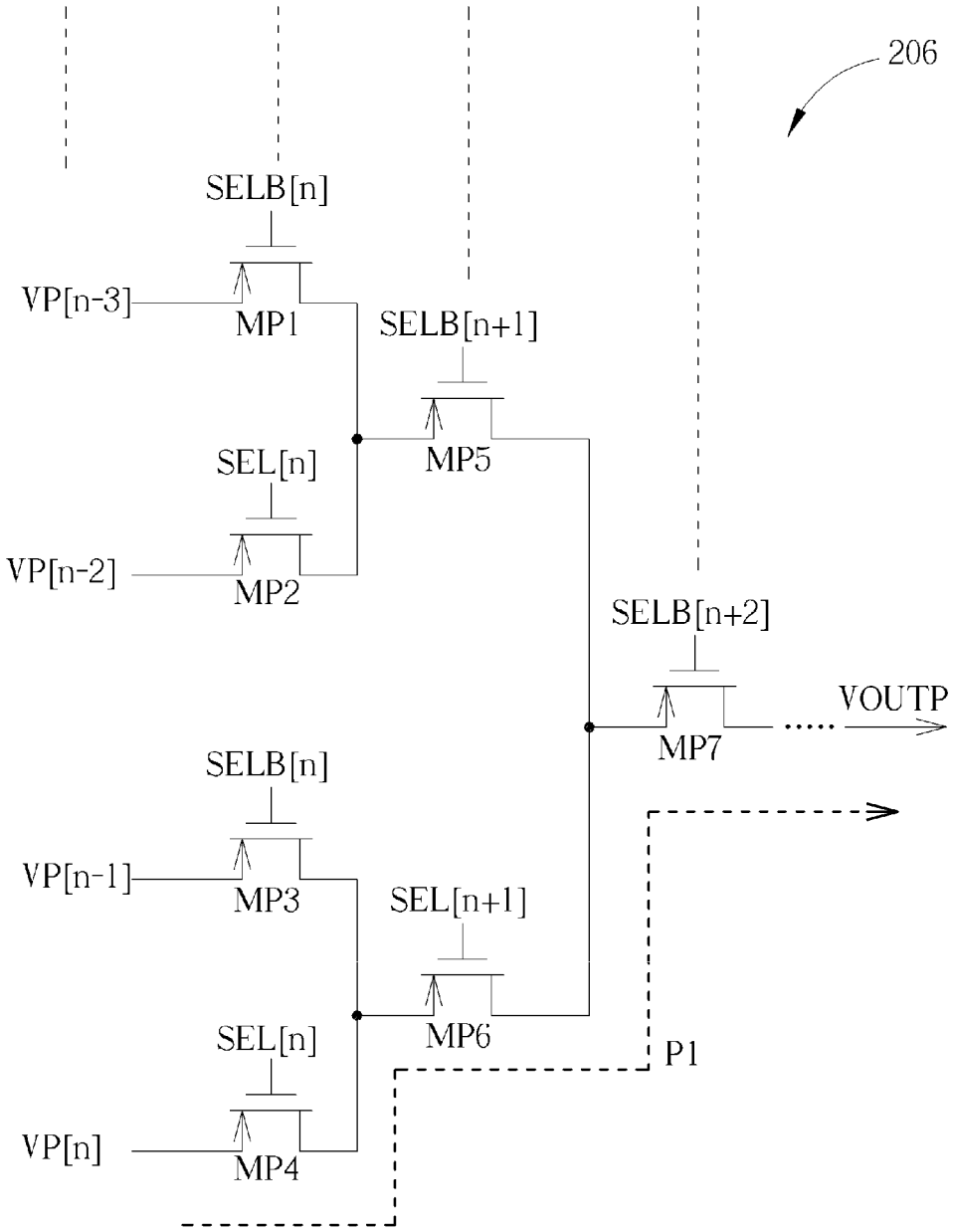
FIG. 2B PRIOR ART
FIG. 2B and FIG. 2C are schematic diagrams of partial circuits of a p-type digital to analog converter and an n-type digital to analog converter in FIG. 2A, respectively.
Figure 2C:
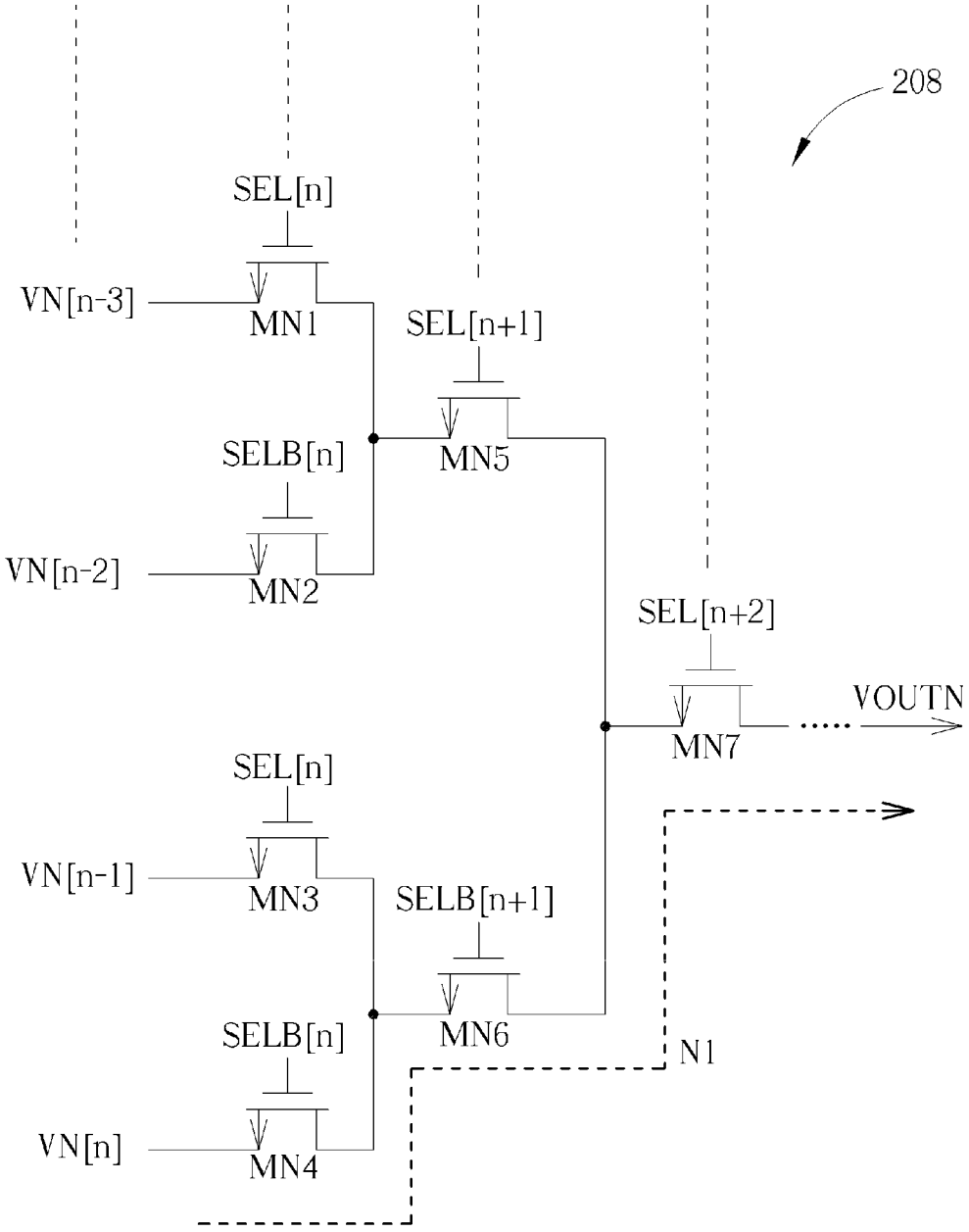
FIG. 2C PRIOR ART
Figure 3A:
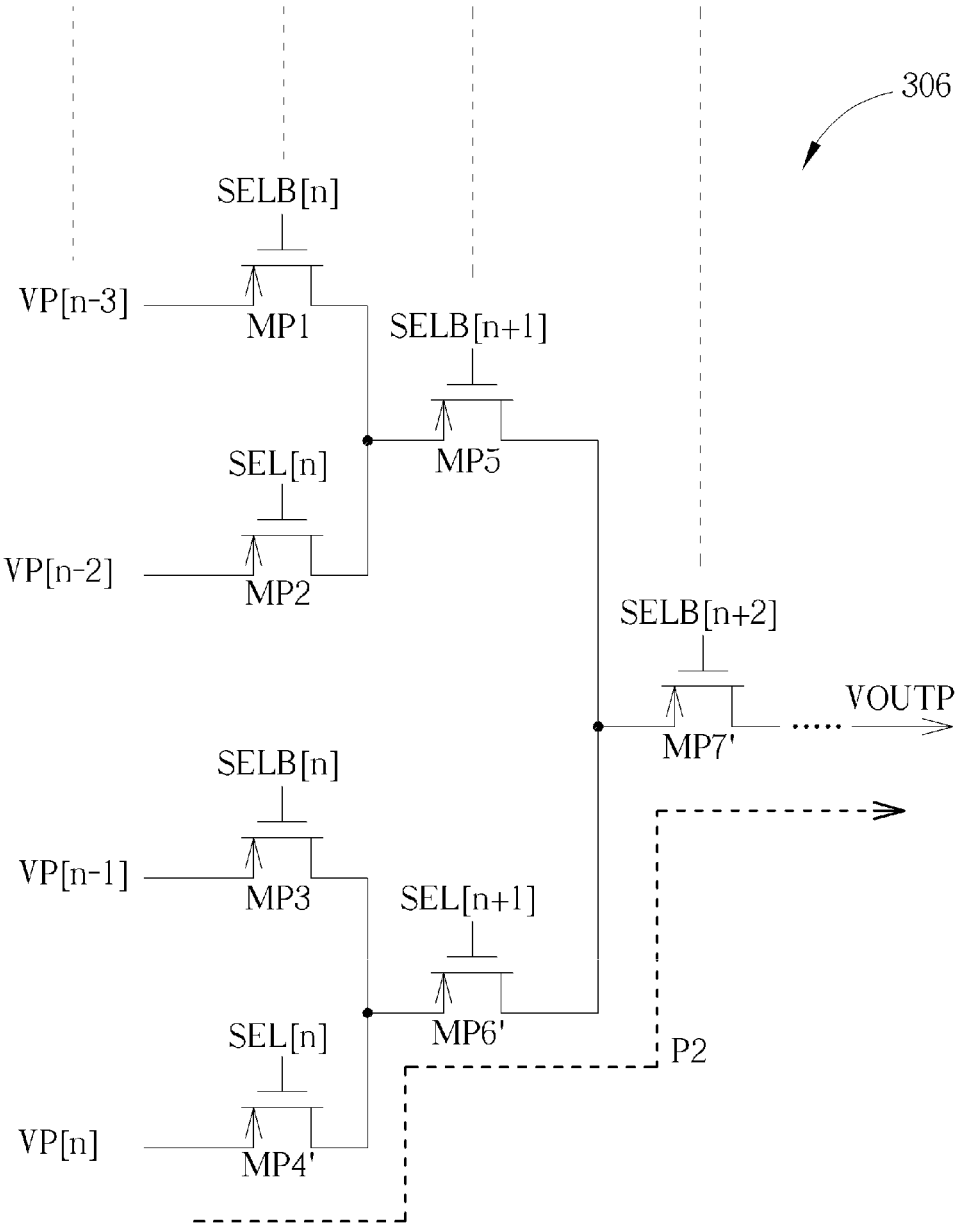
FIG. 3A and FIG. 3B are schematic diagrams of partial circuits of a p-type digital to analog converter and an n-type digital to analog converter utilized for replacing the p-type digital to analog converter and the n-type digital to analog converter in FIG. 2A according to an embodiment of the present invention.
Figure 3B:
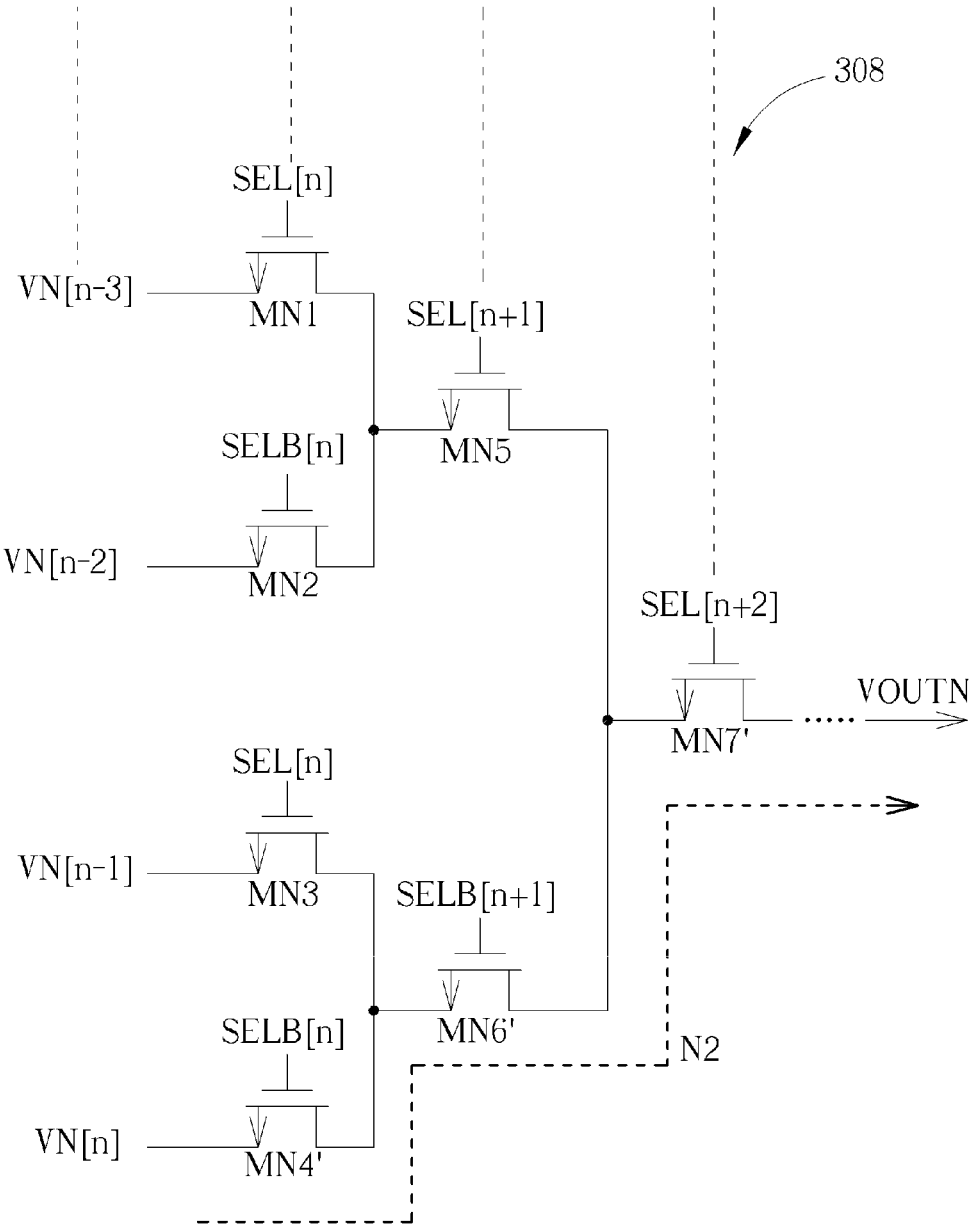

Please refer to FIG. 3A and FIG. 3B, which are schematic diagrams of partial circuits of a p-type digital to analog converter 306 and an n-type digital to analog converter 308 utilized for replacing the p-type digital to analog converter 206 and the n-type digital to analog converter 208 in FIG. 2A according to an embodiment of the present invention. The p-type digital to analog converter 306 is partially similar to the p-type digital to analog converter 206, and hence elements and signals with similar functions are denoted by the same symbols. The main difference between the p-type digital to analog converter 306 and the p-type digital to analog converter 206 is that a transmission path P2 corresponding to a receiving terminal receiving the positive Gamma voltage VP[n] closest to the middle voltage VDDA/2 among the positive Gamma voltages VP[0]~VP[n] (i.e. the minimal of the positive Gamma voltages VP[0]~VP[n]) has lower on-resistance than transmission paths corresponding to the positive Gamma voltages VP[0]~VP[n−1] when a same source-to-gate voltage is applied. Similarly, in the n-type digital to analog converter 308, a transmission path N2 corresponding to a receiving terminal receiving the negative Gamma voltage VN[n] closest to the middle voltage VDDA/2 among the negative Gamma voltages VN[0]~VN[n] (i.e. the maximal of the negative Gamma voltages VN[0]~VN[n]) has lower on-resistance than transmission paths corresponding to the negative Gamma voltages VN[0]~VN[n−1] when a same source-to-gate voltage is applied.

In such a condition, though the positive Gamma voltage VP[n] and the negative Gamma voltage VN[n] cause lower source-to-gate voltages in comparison with the other positive Gamma voltages VP[0]~VP[n−1] and the other negative Gamma voltages VN[0]~VN[n−1], since the transmission paths P2 and N2 corresponding to the positive Gamma voltage VP[n] and the negative Gamma voltage VN[n] have lower on-resistance than the transmission paths corresponding to the positive Gamma voltages VP[0]~VP[n−1] and the negative Gamma voltages VN[0]~VN[n−1] when a same source-to-gate voltage is applied, even in many kinds of product applications with high image updating rate, data can still be transmitted normally as the other transmission paths. As a result, the present invention can transmit the Gamma voltage closest to the middle voltage VDDA/2 timely by reducing on-resistance of the transmission path corresponding to the Gamma voltage closest to the middle voltage VDDA/2.

In detail, in the p-type digital to analog converter 306, p-type transistors MP4', MP6', and MP7' in the transmission path P2 have lower on-resistance than p-type transistors MP1~MP3, MP5, and other p-type transistors when a same source-to-gate voltage is applied, and hence the transmission path P2 has lower on-resistance than other transmission paths when a same source-to-gate voltage is applied. Among those p-type transistors, the p-type transistors MP4', MP6', and MP7' have lower threshold voltages, thinner gate oxides, or greater mobility than the p-type transistors MP1~MP3, MP5, and other p-type transistors. In such a condition, since on-resistance is negatively related to the overdrive voltage, and the overdrive voltage is a difference between the gate-to-source voltage and the threshold voltage of the transistor (i.e. Vgs−Vt), the p-type transistors MP4', MP6', and MP7' have lower threshold voltages and have greater overdrive voltages, and thus have lower on-resistance to transmit the Gamma voltage closest to the middle voltage VDDA/2 timely.

Similarly, in the n-type digital to analog converter 308, n-type transistors MN4', MN6', and MN7' in the transmission path N2 may also have lower on-resistance, and hence the transmission path N2 has lower on-resistance than other transmission paths when a same source-to-gate voltage is applied to transmit the Gamma voltage closest to the middle voltage VDDA/2 timely. As a result, the present invention can reduce on-resistance of the transmission path corresponding to the Gamma voltage closest to the middle voltage VDDA/2 by reducing on-resistance of the transistors in the transmission path corresponding to the Gamma voltage closest to the middle voltage VDDA/2, so as to transmit the Gamma voltage closest to the middle voltage VDDA/2 timely.

Noticeably, the spirit of the present invention is to transmit the Gamma voltage closest to the middle voltage VDDA/2 timely by reducing on-resistance of the transmission path corresponding to the Gamma voltage closest to the middle voltage VDDA/2. Those skilled in the art can make modifications or alterations accordingly. For example, in the above embodiment, all of the transistors are illustrated as Metal oxide semiconductor (MOS) transistors, but can also be other kinds of transistors. Besides, the above embodiment illustrates that all transistors in the transmission path corresponding to the Gamma voltage closest to the middle voltage VDDA/2 have lower on-resistance, but in other embodiments, only at least one of the transistors in the transmission path corresponding to the Gamma voltage closest to the middle voltage VDDA/2 needs to have lower on-resistance to achieve lower on-resistance than other transmission paths. Moreover, in addition to reducing on-resistance of the transistors in the transmission path, other methods can also be utilized to reduce on-resistance of the transmission path corresponding to the Gamma voltage closest to the middle voltage VDDA/2.

Figure 4A:
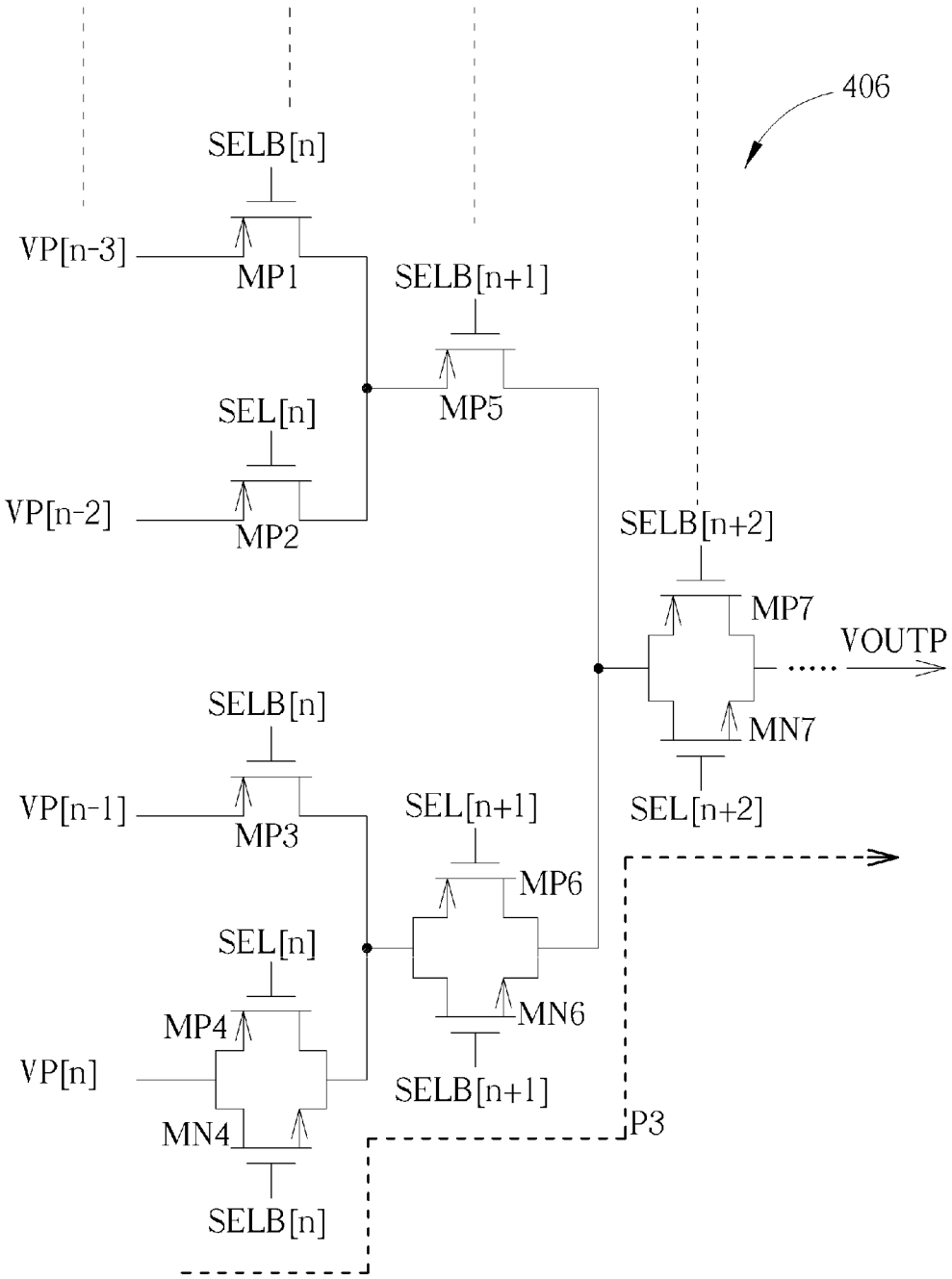
FIG. 4A and FIG. 4B are schematic diagrams of partial circuits of another p-type digital to analog converter and another n-type digital to analog converter utilized for replacing the p-type digital to analog converter and the n-type digital to analog converter in FIG. 2A according to an embodiment of the present invention.
Figure 4B:
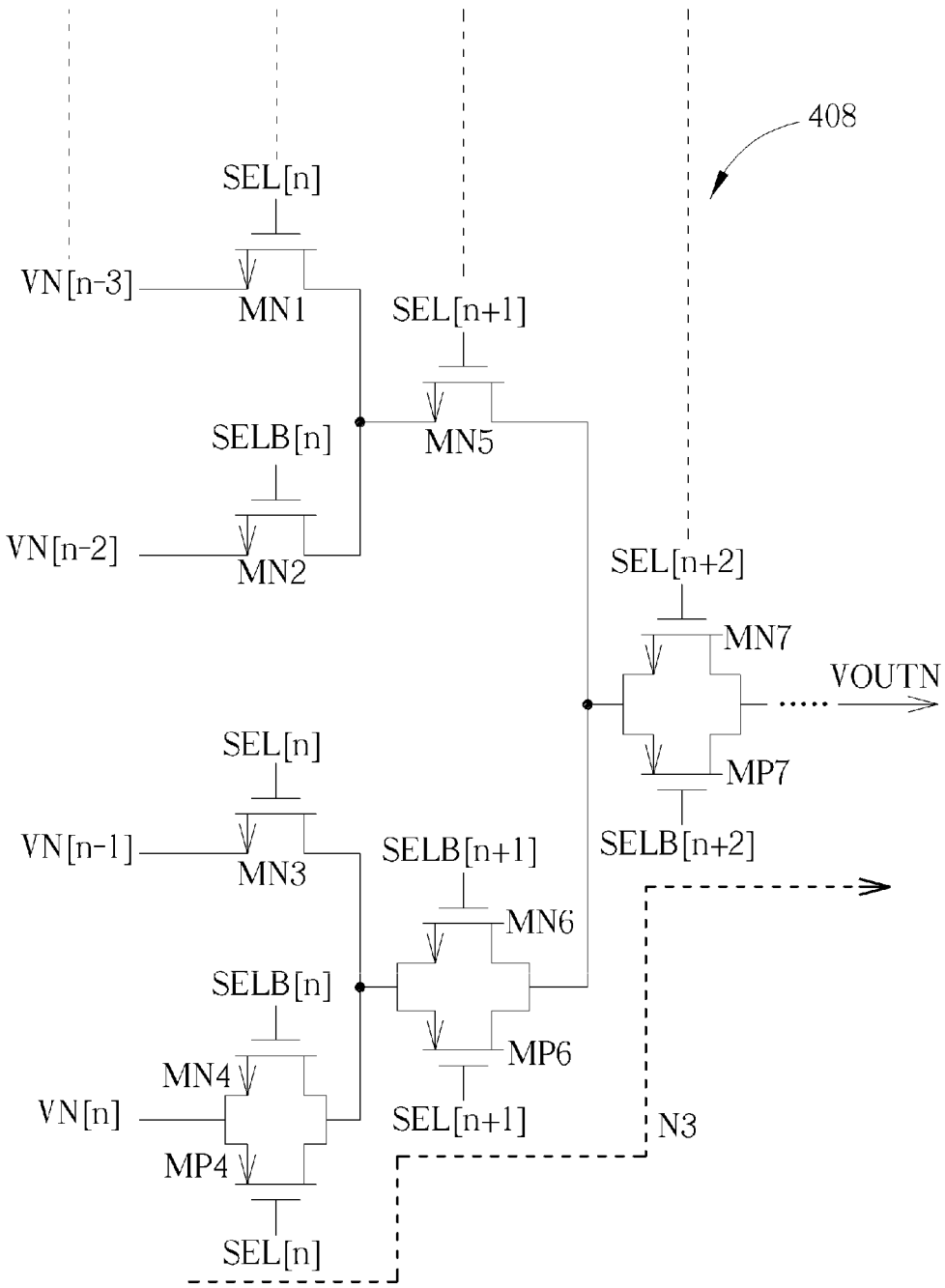

For example, please refer to FIG. 4A and FIG. 4B, which are schematic diagrams of partial circuits of another p-type digital to analog converter 406 and another n-type digital to analog converter 408 utilized for replacing the p-type digital to analog converter 206 and the n-type digital to analog converter 208 in FIG. 2A according to an embodiment of the present invention. The p-type digital to analog converter 406 is partially similar to the p-type digital to analog converter 206, and hence elements and signals with similar functions are denoted by the same symbols.

As shown in FIG. 4A, in this embodiment, the main difference between the p-type digital to analog converter 406 and the p-type digital to analog converter 206 is that in a transmission path P3 corresponding to a receiving terminal receiving the positive Gamma voltage VP[n] closest to the middle voltage VDDA/2 among the positive Gamma voltages VP[0]~VP[n] in the p-type digital to analog converter 406, the p-type transistors MP4, MP6, and MP7 in the transmission path P3 are connected to n-type transistors MN4, MN6, and MN7 in parallel, respectively, to form transmission gates. The n-type transistors MN4, MN6, and MN7 can output the positive Gamma voltage VP[n] as the output voltage VOUTP according to the digital select signal DSS (the transistors MN4, MN6, and MN7 are controlled by select signals inverse to those of the p-type transistors MP4, MP6, and MP7, respectively). Therefore, effective on-resistance of the transmission path P3 can be reduced by connecting paths in parallel to reduce time constant, so as to transmit the positive Gamma voltage VP[n] closest to the middle voltage VDDA/2 timely.

Similarly, as shown in FIG. 4B, the main difference between the n-type digital to analog converter 408 and the n-type digital to analog converter 208 is that in a transmission path N3 corresponding to a receiving terminal receiving the negative Gamma voltage VN[n] closest to the middle voltage VDDA/2 among the negative Gamma voltages VN[0]~VN[n] in the n-type digital to analog converter 408, the n-type transistors MN4, MN6, and MN7 in the transmission path N3 are connected to p-type transistors MP4, MP6, and MP7 in parallel, respectively, to form transmission gates. The p-type transistors MP4, MP6, and MP7 can output the negative Gamma voltage VN[n] as the output voltage VOUTN according to the digital select signal DSS (the transistors MP4, MP6, and MP7 are controlled by select signals inverse to those of the n-type transistors MN4, MN6, and MN7, respectively). Therefore, effective on-resistance of the transmission path N3 can be reduced by connecting paths in parallel to reduce time constant, so as to transmit the negative Gamma voltage VN[n] closest to the middle voltage VDDA/2 timely.

Noticeably, the above embodiment illustrates that all transistors in the transmission path corresponding to the Gamma voltage closest to the middle voltage VDDA/2 are connected to inverse type transistors in parallel to form transmission gates, but in other embodiments, only at least one of the transistors in the transmission paths corresponding to the Gamma voltage closest to the middle voltage VDDA/2 needs to be connected to at least one inverse type transistor in parallel to form at least one transmission gate to achieve lower on-resistance than other transmission paths. As a result, by connecting the transistors of the transmission path corresponding to the Gamma voltage closest to the middle voltage VDDA/2 to inverse type transistors in parallel to form transmission gates, the present embodiment can reduce effective on-resistance of the transmission path by connecting paths in parallel, so as to transmit the Gamma voltage closest to the middle voltage VDDA/2 timely.

Figure 5A:
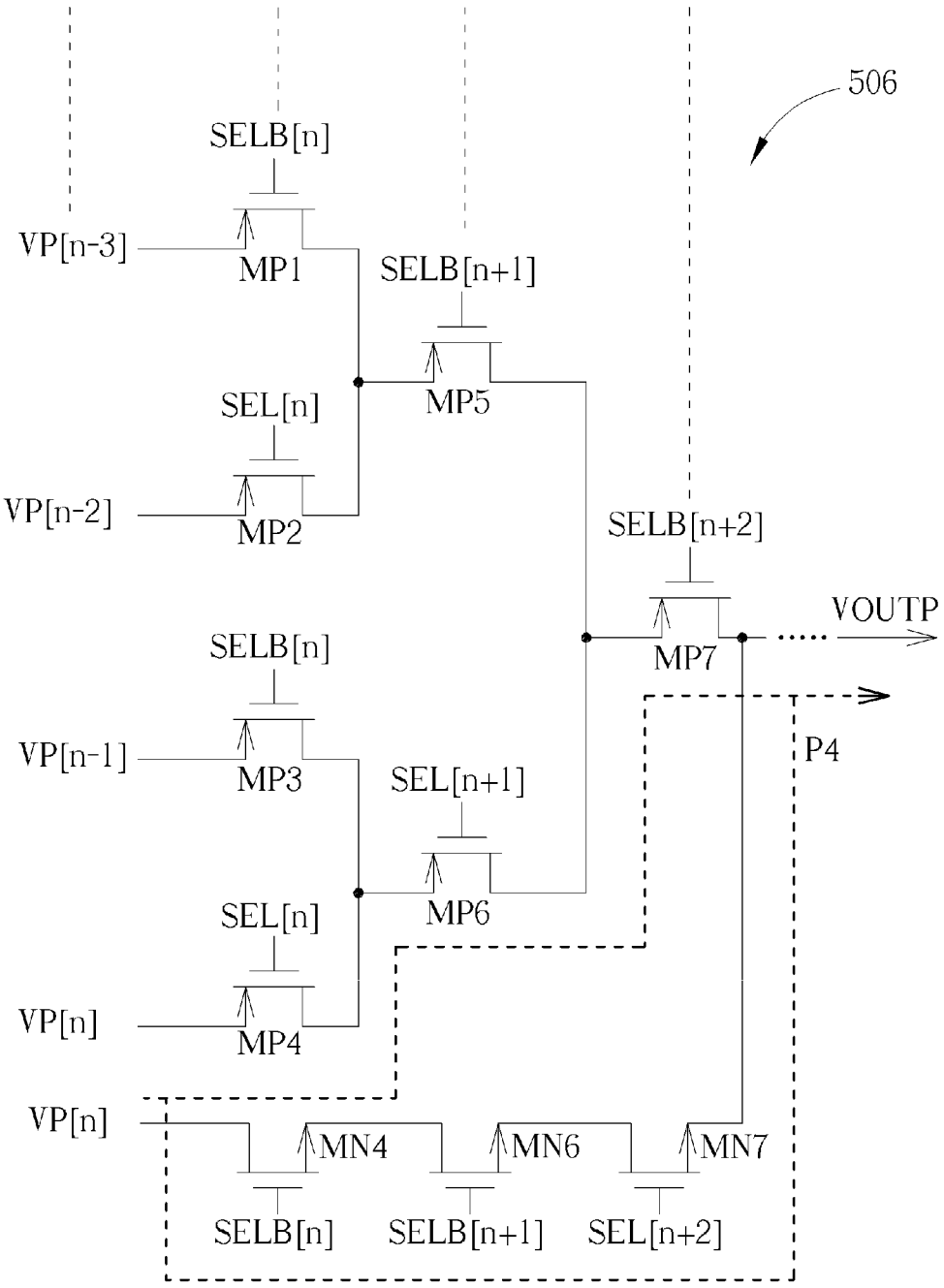
FIG. 5A and FIG. 5B are schematic diagrams of partial circuits of a further p-type digital to analog converter and a further n-type digital to analog converter utilized for replacing the p-type digital to analog converter and the n-type digital to analog converter in FIG. 2A according to an embodiment of the present invention.
Figure 5B:
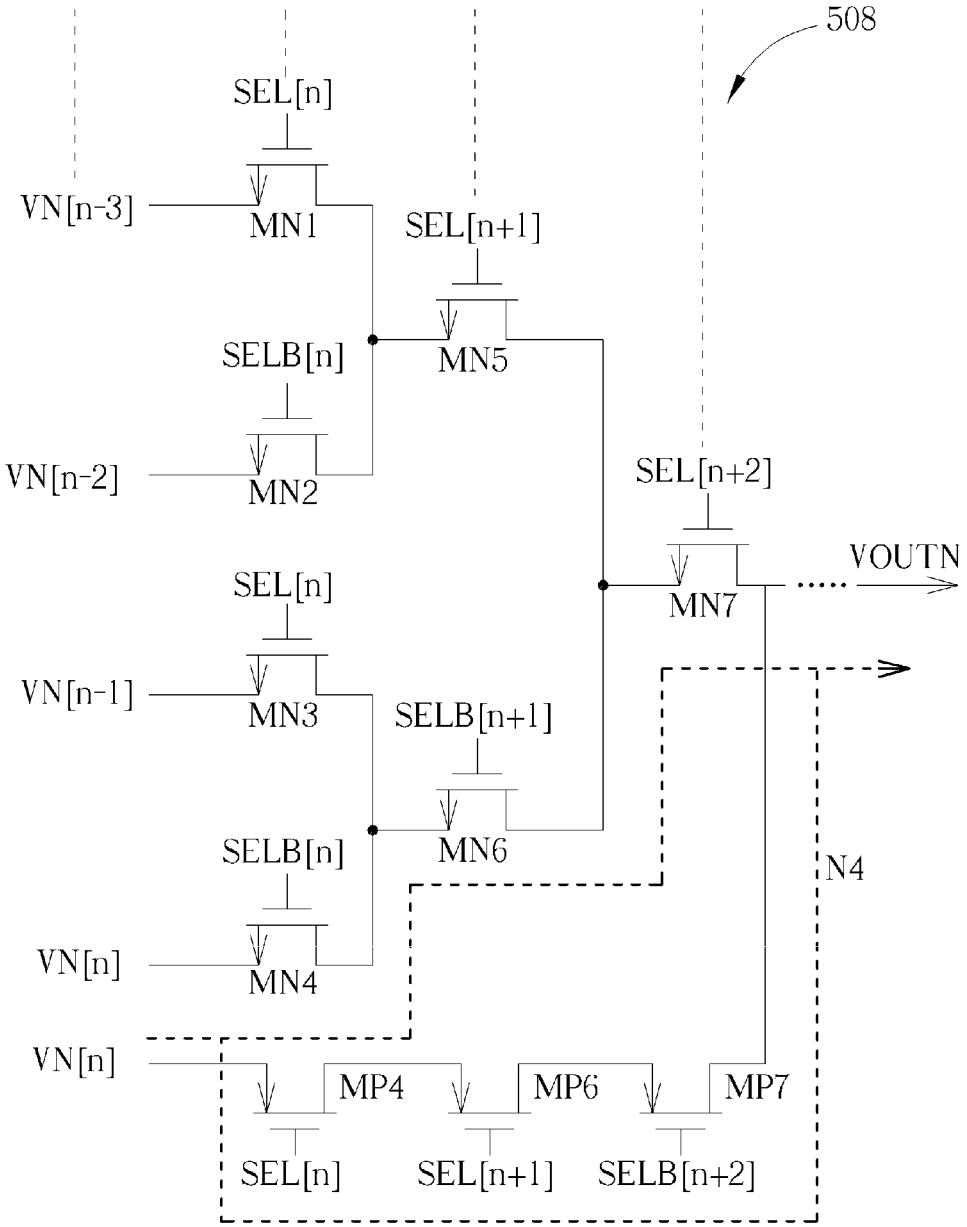

On the other hand, please refer to FIG. 5A and FIG. 5B, which are schematic diagrams of partial circuits of a further p-type digital to analog converter 506 and a further n-type digital to analog converter 508 utilized for replacing the p-type digital to analog converter 206 and the n-type digital to analog converter 208 in FIG. 2A according to an embodiment of the present invention. The p-type digital to analog converter 506 is partially similar to the p-type digital to analog converter 206, and hence elements and signals with similar functions are denoted by the same symbols.

As shown in FIG. 5A, in this embodiment, the main difference between the p-type digital to analog converter 506 and the p-type digital to analog converter 206 is in a transmission path P4 corresponding to a receiving terminal receiving the positive Gamma voltage VP[n] closest to the middle voltage VDDA/2 among the positive Gamma voltages VP[0]~VP[n] in the p-type digital to analog converter 506. The transmission path P4 includes a branch for outputting the output voltage VOUTP through p-type transistors MP4, MP6, MP7, and further includes n-type transistors MN4, MN6, and MN7 in another branch connected to the p-type transistors MP4, MP6, and MP7 in parallel and coupled between the receiving terminal and the output voltage VOUTP, for outputting the positive Gamma voltage VP[n] as the output voltage VOUTP according to the digital select signal DSS (the n-type transistors MN4, MN6, and MN7 are controlled by select signals inverse to those of the p-type transistors MP4, MP6, and MP7, respectively). Therefore, effective on-resistance of the transmission path P4 can be reduced by connecting paths in parallel to reduce time constant, so as to transmit the positive Gamma voltage VP[n] closest to the middle voltage VDDA/2 timely.

Similarly, as shown in FIG. 5B, the main difference between the n-type digital to analog converter 508 and the n-type digital to analog converter 208 is in a transmission path N4 corresponding to a receiving terminal receiving the negative Gamma voltage VN[n] closest to the middle voltage VDDA/2 among the negative Gamma voltages VN[0]~VN[n] in the n-type digital to analog converter 508. The transmission path N4 includes a branch for outputting the output voltage VOUTN through n-type transistors MN4, MN6, MN7, and further includes p-type transistors MP4, MP6, and MP7 in another branch connected to the n-type transistors MN4, MN6, and MN7 in parallel and coupled between the receiving terminal and the output voltage VOUTN, for outputting the negative Gamma voltage VN[n] as the output voltage VOUTN according to the digital select signal DSS (the p-type transistors MP4, MP6, and MP7 are controlled by select signals inverse to those of the n-type transistors MN4, MN6, and MN7, respectively). Therefore, effective on-resistance of the transmission path N4 can be reduced by connecting paths in parallel to reduce time constant, so as to transmit the negative Gamma voltage VN[n] closest to the middle voltage VDDA/2 timely.

Noticeably, the above embodiment illustrates the transmission path corresponding to the Gamma voltage closest to the middle voltage VDDA/2 further includes a same number of inverse type transistors in another branch connected in parallel, but in other embodiments, the transmission path corresponding to the Gamma voltage closest to the middle voltage VDDA/2 only needs to further include at least one inverse type transistor in another branch connected in parallel to achieve lower on-resistance than other transmission paths. As a result, with the parallel connected inverse type transistors in the transmission path corresponding to the Gamma voltage closest to the middle voltage VDDA/2, the present embodiment can reduce effective on-resistance of the transmission path by connecting paths in parallel, so as to transmit the Gamma voltage closest to the middle voltage VDDA/2 timely.

Figure 6:
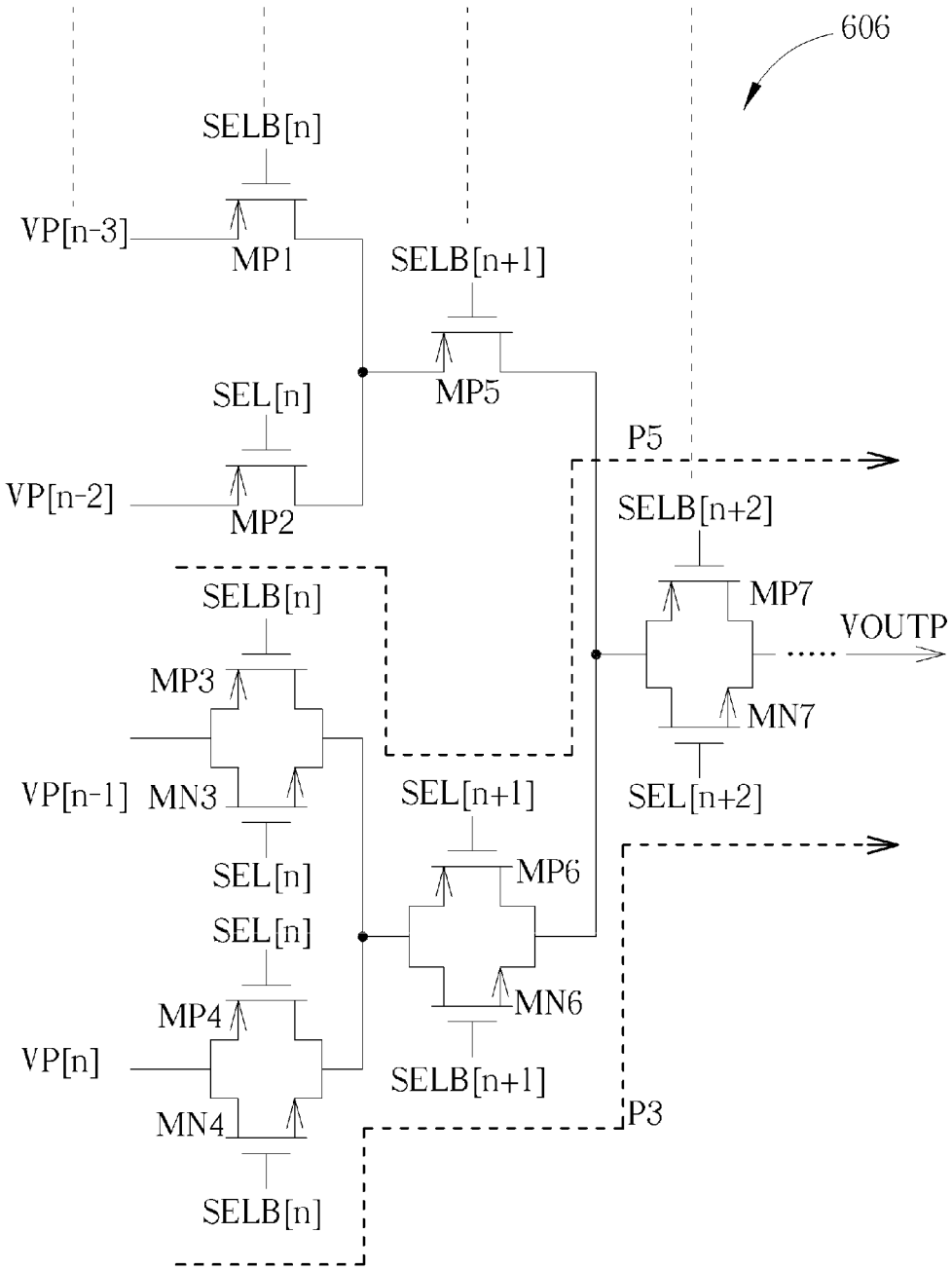
FIG. 6 is a schematic diagram of a partial circuit of a p-type digital to analog converter utilized for replacing the p-type digital to analog converter in FIG. 2A according to an embodiment of the present invention.

Moreover, please refer to FIG. 6, which is a schematic diagram of a partial circuit of a p-type digital to analog converter 606 utilized for replacing the p-type digital to analog converter 206 in FIG. 2A according to an embodiment of the present invention. The p-type digital to analog converter 606 is an alteration of the p-type digital to analog converter 406. The p-type digital to analog converter 606 is partially similar to the p-type digital to analog converter 406, and hence elements and signals with similar functions are denoted by the same symbols. The main difference between the p-type digital to analog converter 606 and the p-type digital to analog converter 406 is that in a transmission path P5 corresponding to a receiving terminal receiving the positive Gamma voltage VP[n−1] second closest to the middle voltage VDDA/2 among the positive Gamma voltages VP[0]~VP[n] in the p-type digital to analog converter 606, the p-type transistor MP3 is further connected to an n-type transistor MN3 in parallel.

In such a condition, since the positive Gamma voltage VP[n−1] second closest to the middle voltage VDDA/2 may also not be able to output the output voltage VOUTP timely due to smaller gate-to-source voltage, and hence the transmission path P5 can reduce effective on-resistance with a parallel path overlapped with the transmission path P3, and can further reduce effective on-resistance with a parallel path of the transmission gate formed by the n-type transistor MN3 connected to the p-type transistor MP3 in parallel. Noticeably, the above embodiment illustrates the transistors in the transmission path corresponding to the Gamma voltage second closest to the middle voltage VDDA/2 connected to inverse type transistors in parallel to form transmission gates, to achieve lower on-resistance than other transmission paths other than the transmission path P3. However, in other embodiments, the above two other methods can also be referred for implementation, i.e. by reducing on-resistance of the transistors in the transmission path corresponding to the Gamma voltage second closest to the middle voltage VDDA/2, or by parallel connecting inverse type transistors in another branch of the transmission path corresponding to the Gamma voltage second closest to the middle voltage VDDA/2, to achieve lower on-resistance than other transmission paths other than the transmission path P3. By the same token, the realization of the n-type digital to analog converters can be achieved. As a result, the present embodiment can make the transmission path corresponding to the Gamma voltage second closest to the middle voltage VDDA/2 have lower on-resistance than other transmission paths other than the transmission path corresponding to the Gamma voltage closest to the middle voltage VDDA/2 when a same source-to-gate voltage is applied.

Furthermore, if other positive Gamma voltages close to the middle voltage VDDA/2 among the positive Gamma voltages VP[0]~VP[n] may also not be able to output the output voltage VOUTP timely due to smaller gate-to-source voltages, the above three other methods can also be referred for implementation, such that the transmission paths corresponding to the positive Gamma voltages have lower on-resistance than other transmission paths other than the transmission path corresponding to the Gamma voltage closest to the middle voltage VDDA/2 when a same source-to-gate voltage is applied. Noticeably, the above three methods in each embodiment are implemented separately. However, in other embodiments, the three methods can also be implemented together to achieve lower on-resistance in the transmission paths.

In the prior art, with the increase of definition, the quantity of transistors in the transmission paths may increase, such that on-resistance of the transmission paths may also increase. The Gamma voltages close to the middle voltage VDDA/2 in the digital to analog converter may have lower gate-to-source voltages, and hence on-resistance of each transistor is higher, such that the signal can not output timely. In comparison, the present invention can transmit the Gamma voltages close to the middle voltage VDDA/2 timely by reducing on-resistance in the transmission paths corresponding to the Gamma voltages close to the middle voltage VDDA/2.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A digital to analog converter (DAC), for a source driver chip of a liquid crystal display (LCD) device, the digital to analog converter comprising:

an output terminal, for outputting an output voltage;

a plurality of receiving terminals, for receiving a plurality of Gamma voltages; and a plurality of transmission paths, comprising a plurality of first-type transistors coupled between the plurality of receiving terminals and the output terminal, respectively, for outputting one of the plurality of Gamma voltages as the output voltage according to a digital select signal;

wherein a first transmission path corresponding to a first receiving terminal receiving a first Gamma voltage closest to a middle voltage among the plurality of Gamma voltages has lower on-resistance than other transmission paths among the plurality of transmission paths;

wherein the first Gamma voltage results in the first-type transistor of the first transmission path having a smaller source-to-gate voltage.

2. The digital to analog converter of claim 1, wherein the plurality of Gamma voltages are a plurality of positive Gamma voltages, the plurality of first-type transistors are a plurality of p-type transistors, and the first Gamma voltage is minimal among the plurality of Gamma voltages.

3. The digital to analog converter of claim 1, wherein the plurality of Gamma voltages are a plurality of negative Gamma voltages, the plurality of first-type transistors are a plurality of n-type transistors, and the first Gamma voltage is maximal among the plurality of Gamma voltages.

4. The digital to analog converter of claim 1, wherein the middle voltage is a middle value between a plurality of positive Gamma voltages and a plurality of negative Gamma voltages.

5. The digital to analog converter of claim 1, wherein at least one of a first plurality of first-type transistors of the first transmission path has lower on-resistance than other first-type transistors.

6. The digital to analog converter of claim 5, wherein the at least one of the first plurality of first-type transistors of the first transmission path has a lower threshold voltage, a thinner gate oxide, or greater mobility than the other first-type transistors.

7. The digital to analog converter of claim 1, wherein at least one of a first plurality of first-type transistors of the first transmission path is connected to at least one second-type transistor in parallel, respectively, for outputting the first Gamma voltage as the output voltage according to the digital select signal.

8. The digital to analog converter of claim 1, wherein the first transmission path further comprises at least one second-type transistor parallel connected to a first plurality of first-type transistors coupled between the first receiving terminal and the output terminal, for outputting the first Gamma voltage as the output voltage according to the digital select signal.

9. The digital to analog converter of claim 1, wherein a second transmission path corresponding to a second receiving terminal receiving a second Gamma voltage second closest to the middle voltage among the plurality of Gamma voltages has lower on-resistance than other transmission paths other than the first transmission path among the plurality of transmission paths.

10. The digital to analog converter of claim 1, wherein at least one transmission path corresponding to at least one receiving terminal receiving at least one Gamma voltage of at least one of the middle voltage among the plurality of Gamma voltages has lower on-resistance than other transmission paths other than the first transmission path among the plurality of transmission paths.

11. A source driver chip, for a liquid crystal display (LCD) device, comprising:

at least one Gamma voltage generator, for generating a plurality of Gamma voltages, respectively;

at least one output buffer, for performing driving with an output voltage, respectively; and at least one digital to analog converter (DAC), each comprising:

an output terminal, for outputting the output voltage;

a plurality of receiving terminals, for receiving the plurality of Gamma voltages; and a plurality of transmission paths, comprising a plurality of first-type transistors coupled between the plurality of receiving terminals and the output terminal, respectively, for outputting one of the plurality of Gamma voltages as the output voltage according to a digital select signal;

wherein a first transmission path corresponding to a first receiving terminal receiving a first Gamma voltage closest to a middle voltage among the plurality of Gamma voltages has lower on-resistance than other transmission paths among the plurality of transmission paths;

wherein the first Gamma voltage results in the first-type transistor of the first transmission path having a smaller source-to-gate voltage.

12. The source driver chip of claim 11, wherein the each digital to analog converter is a p-type digital to analog converter, the plurality of Gamma voltages are a plurality of positive Gamma voltages, the plurality of first-type transistors are a plurality of p-type transistors, and the first Gamma voltage is minimal among the plurality of Gamma voltages.

13. The source driver chip of claim 11, wherein the each digital to analog converter is an n-type digital to analog converter, the plurality of Gamma voltages are a plurality of negative Gamma voltages, the plurality of first-type transistors are a plurality of n-type transistors, and the first Gamma voltage is maximal among the plurality of Gamma voltages.

14. The source driver chip of claim 11, wherein the middle voltage is a middle value between a plurality of positive Gamma voltages and a plurality of negative Gamma voltages.

15. The source driver chip of claim 11, wherein at least one of a first plurality of first-type transistors of the first transmission path has lower on-resistance than other first-type transistors.

16. The source driver chip of claim 15, wherein the at least one of the first plurality of first-type transistors of the first transmission path has a lower threshold voltage, a thinner gate oxide, or greater mobility than the other first-type transistors.

17. The source driver chip of claim 11, wherein at least one of a first plurality of first-type transistors of the first transmission path is connected to at least one second-type transistor in parallel, respectively, for outputting the first Gamma voltage as the output voltage according to the digital select signal.

18. The source driver chip of claim 11, wherein the first transmission path further comprises at least one second-type transistor parallel connected to a first plurality of first-type transistors coupled between the first receiving terminal and the output terminal, for outputting the first Gamma voltage as the output voltage according to the digital select signal.

19. The source driver chip of claim 11, wherein a second transmission path corresponding to a second receiving terminal receiving a second Gamma voltage second closest to the middle voltage among the plurality of Gamma voltages has lower on-resistance than other transmission paths other than the first transmission path among the plurality of transmission paths.

20. The source driver chip of claim 11, wherein at least one transmission path corresponding to at least one receiving terminal receiving at least one Gamma voltage of the at least one middle voltage among the plurality of Gamma voltages has lower on-resistance than other transmission paths other than the first transmission path among the plurality of transmission paths.

* * * * *